United States Patent [19]

Hoehn

[11] Patent Number: 4,666,064

[45] Date of Patent: May 19, 1987

[54] DISPENSING DEVICE FOR "BAG-IN-BOX" PACKAGES, BAG AND DEVICE FOR FILLING BAGS

[76] Inventor: John W. Hoehn, 7 Webb Street, Brighton, VIC 3186, Australia

[21] Appl. No.: 713,401

[22] PCT Filed: Jun. 15, 1984

[86] PCT No.: PCT/CH84/00098

§ 371 Date: Feb. 27, 1985

§ 102(e) Date: Feb. 27, 1985

[87] PCT Pub. No.: WO85/00155

PCT Pub. Date: Jan. 17, 1985

[30] Foreign Application Priority Data

Jun. 28, 1983 [AU] Australia ..... 0031/83

[51] Int. Cl.[4] ..... B65D 35/56

[52] U.S. Cl. ..... 222/105; 222/183; 222/517

[58] Field of Search ..... 222/92, 105, 107, 511, 222/517, 544, 556, 566, 183, 505, 531, 567; 383/906

[56] References Cited

U.S. PATENT DOCUMENTS

| | | | |
|---|---|---|---|
| 3,081,003 | 3/1963 | Baxter et al. | 222/105 |
| 3,116,854 | 1/1964 | Rabb et al. | 222/183 |
| 3,255,932 | 6/1966 | Hunter et al. | 222/105 X |
| 3,279,656 | 10/1966 | Axtell et al. | 222/105 X |
| 3,400,866 | 9/1968 | Fattori | 222/511 |
| 4,286,733 | 9/1981 | Weikert | 222/105 |

FOREIGN PATENT DOCUMENTS

| | | |
|---|---|---|
| 2218481 | 10/1973 | Fed. Rep. of Germany . |
| 1367605 | 6/1964 | France . |
| 1448169 | 6/1966 | France . |
| 1075713 | 7/1967 | United Kingdom . |
| 1247191 | 9/1971 | United Kingdom . |

OTHER PUBLICATIONS

European Patent Application, 29,419; Lindqvist; 5-1981.

*Primary Examiner*—Joseph J. Rolla
*Assistant Examiner*—Michael S. Happert
*Attorney, Agent, or Firm*—Ostrolenk, Faber, Gerb & Soffen

[57] ABSTRACT

A dispensing device (50) for application to a flexible bag (20) as in a "bag-in-box" packaging system, is fastened to the outer cardboard box (14) of the bag. A first portion (52), connected to a second one (51) via a hinge region (53) is swung up and the still-closed bag (20') is pulled through the opening in the device. After closing and locking (54, 57) the portions (52, 51), clamping or valve members (49, 48) act against each other through the inserted bag (20) and seal it. The protuberant corner of the bag (20') is then opened by the user. By manual action by means of an actuating lever (55) against a closure wall (59) bearing one of the clamping members (49), the opening for the dispensing of the bag filling product can be selectively opened. The swing position of the portions (51, 52) at the hinge (53) is not affected thereby and the portions (51, 52) remain locked in one another (54, 57).

10 Claims, 32 Drawing Figures

DISPENSING DEVICE FOR "BAG-IN-BOX" PACKAGES, BAG AND DEVICE FOR FILLING BAGS

The present invention relates to an improvement in packages which are commonly known as "bag-in-box" packages. This is a packaging system where a bag of flexible material such as film is filled, for instance, with a liquid product through a corresponding opening, possibly with flange in the bag, whereupon a dispensing device is provided at the opening and the bag together with the applied dispensing device is then placed in a stiff envelope such as a cardboard box. Most commonly, liquids such as wine, fruit juice and edible oils are packaged in this manner.

The method commonly consists therein that a bag manufacturer manufactures for the above-mentioned insert a bag of suitable flexible foil or film having a plastic flange in the region of one of the bag corners. The dispensing device is then pressed into the flange and, in this condition, the bag and dispensing device are fed to a filling device in as aseptic a condition as possible. When the bag arrives at the filling device, the dispensing device is removed, the bag is evacuated and then filled through the flange opening with the desired liquid product, a nitrogen zone being provided around the flange area where air might accumulate. The dispensing device is then introduced again and attached to the bag. The filled bag is then introduced into a cardboard box, the dispensing device being present at least in the region of a tear-out opening enabling the end user to install the dispensing device through the tear out opening and then to dispense the liquid product through the use of this device.

This procedure has substantial disadvantages. These disadvantages include difficulties in maintaining aseptic conditions during manufacture and furthermore during the expected shelf-life of a product packed in this way. These conditions have been difficult to achieve because the dispensing device and the flange opening following bag manufacture and before filling must necessarily be left open to the environment. Moreover, the dispensing devices themselves have to be manufactured, stored and assembled under very hygienic conditions. Furthermore, the removal of the dispensing device and then the filling of the bag and the reinsertion of said device result in the possibility of contamination. It should furthermore be noted that it is entirely possible, after the filling of the bag and the application of the dispensing device to the bag, that dirt will penetrate through the dispensing device unless the latter itself has a sealed dispensing opening. This last-mentioned problem has to some extent been solved by providing a sealed dispensing device which is pierced upon the first use thereof, this measure, however, requiring refined and correspondingly expensive manufacture of the dispensing device. All the above factors contribute to a much shorter shelf life for the products packed in this way as compared with the expected storage life based on the characteristics of the film of which the bags are produced.

A further disadvantage of the known systems is that the production method is complicated and slow, and as a result is relatively expensive. While it is possible to automate the manufacturing steps involved, the construction of the dispensing device is often complicated and the filling with removal of the dispensing device, its reinsertion and then attachment to the bag further contribute to a slow cycle of manufacture and consequently to higher manufacturing expenses.

Another disadvantage of the known systems is that when a filled bag with the dispensing device is finally installed in the cardboard package the dispensing device obstructs the proper positioning of the bag in the carton since this device protrudes from the bag. This has the result that it is often difficult for the end user to find the dispensing device in the carton after opening its tear-out opening.

It is thus an object of the present invention to propose an improved method for the preparation of the bag, its filling and the application of the dispensing device which minimizes the contamination problems associated with known methods and to propose an improved dispensing device construction which can be used together with the said method, inter alia, of production of the bag, in accordance with the present invention.

Accordingly, the present invention provides a dispensing device for "bag-in-box" packages having a bag which is filled with material and which is packed in an outer protective container, the device having a dispensing opening which can receive a closed region of the said filled bag, said dispensing opening including manually actuatable clamp means which are movable between a first position and a second position, the first position permitting free movement of the said portion of the bag through the dispensing opening while in the second position the said portion of the bag is gripped and fixed with respect to the dispensing opening and makes it possible for the portion of the bag to be opened manually there, while the said clamp means exerts a sealing pressure on the portion of the bag which has thus been opened, dispensing means being provided in order to open or close the said bag opening and selectively dispense material from the bag while the said clamp means are in said second position.

The aforesaid device makes it possible for it either to be applied by the manufacture to the filled bag or for it to be applied by the final user. The bag remains hermetically sealed until the bag portion extending through the dispensing opening is opened by the end user, for instance by cutting, tearing or the like. If desired, the said dispensing device can be made reusable, thereby minimizing the cost of such packaging systems.

According to the invention there is furthermore proposed a method of bag preparation in which a bag is prepared for the packing of a given, preferably liquid, product, the material is introduced therein, the bag is closed, a dispensing device is applied externally to the bag, the bag material being adapted to pass through a dispensing opening of the dispensing device so as to be opened by the end user, for instance by cutting, tearing or the like. Preferably, the dispensing device is applied to the bag and held fast on it by mechanical clamp means.

Furthermore, the bag preferably comprises locating means in order to assure an accurate locating of the dispensing device on the bag. Preferably, the locating means comprises at least one pair of locating openings which are received over protrusions which are part of the clamping means of the dispensing device. The locating openings are preferably provided on both sides of a corner of the bag. Furthermore, a tear indication is preferably provided between the locating openings and arranged to form an opening in the bag in the intended portion thereof.

The present invention also envisages the provision of a package which comprises a bag of desired flexible material which hermetically encloses a material, preferably a liquid material, said bag comprising a dispensing device applied externally to it, the hermetic closure of the material remaining unaffected by said dispensing device and the dispensing device having a dispensing opening through which flexible material of the bag is caused to project for subsequent opening by an end user.

Further preferred features of the present invention will be understood from the following description given in relation to the figures.

The invention will be explained by way of example with reference to the drawing, in which.

Figure 22:
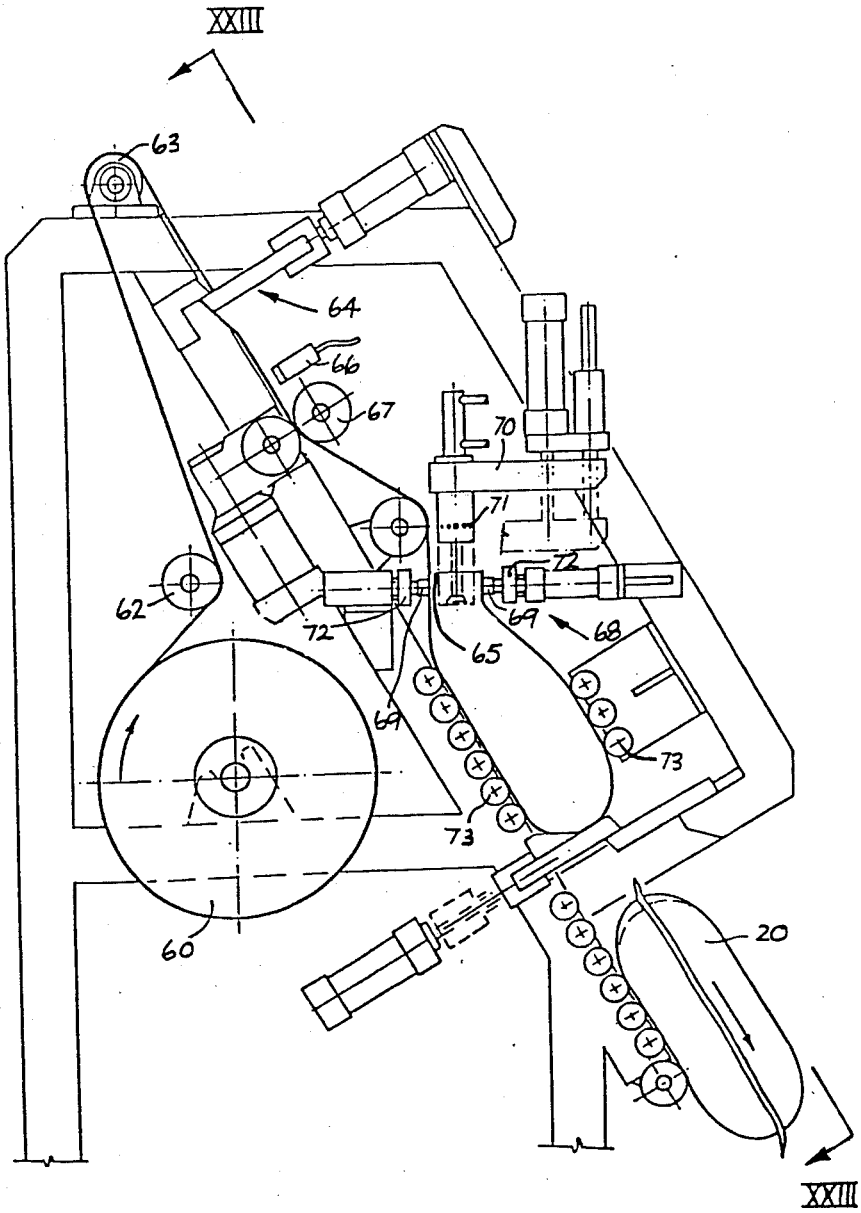
FIG. 22 is a schematic showing of an arrangement for filling flexible bag packages in accordance with the present invention, serving to explain the corresponding preferred method of filling.
Figure 23:
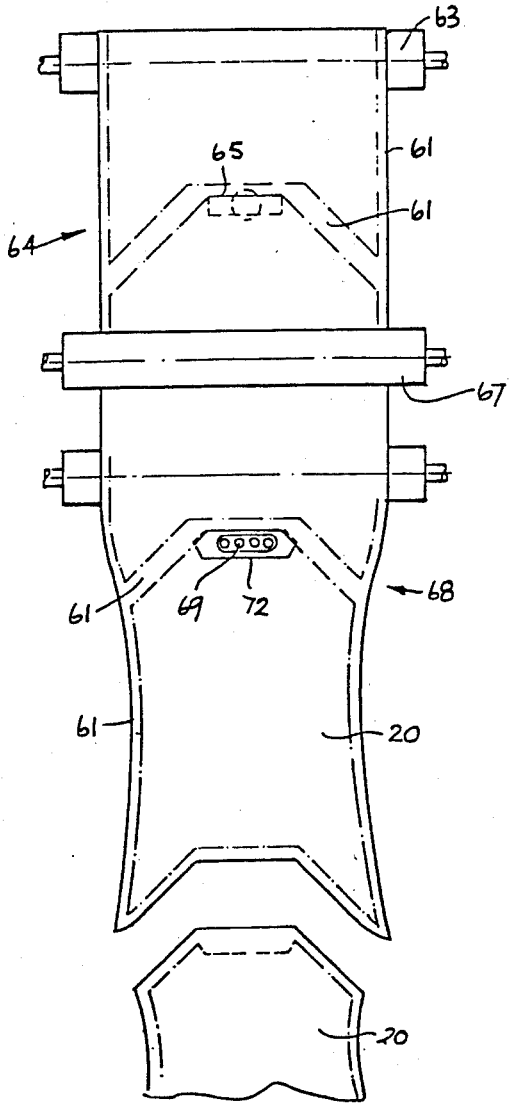
FIG. 23 is a schematic drawing showing in front view the manner of operation of the arrangement according to Fig. 22, certain parts of the arrangement in FIG. 22 having been omitted for the sake of clarity.
Figure 24A:
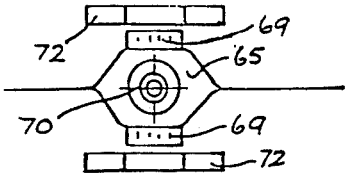

FIGS. 24A, B and C show schematically the sequence of the handling of the opening of the bag for the filling, corresponding to the method described on basis of FIGS. 22 and 23 and the arrangement carrying out this method.

Referring first to FIGS. 1 to 5 there is shown a first preferred embodiment of the dispensing device suitable for use in "bag-in-box" packaging techniques. A dispensing device 50 has a housing 11 of generally cubical shape. The housing is formed essentially of two parts 51 and 52 which are integrally joined together at a hinge portion 53. The first part 51 has a peripheral groove 12 which serves for the application of the dispensing device 50 in a corresponding opening on an outer protective container, such as a carton box 14. The second part 52, as can be noted in particular from FIGS. 3 and 4, can pivot around the hinge portion 53 into a first position, shown in FIG. 3, which makes it possible for a portion of a bag 20 to be pulled into or through the dispensing device. The second part 52 can then be swung back into a second position, shown in Fig. 4, against the part 51 and is clamped fast against it to hold the bag and furthermore to intimately seal the walls of the bag against each other. Preferably, a projection 49 is provided on the part 52 which with the protruding portion 20' of the bag places itself in a corresponding recess 48 in order to assist the sealing closure of the bag when the device is in the position shown in FIG. 4.

Figure 1:
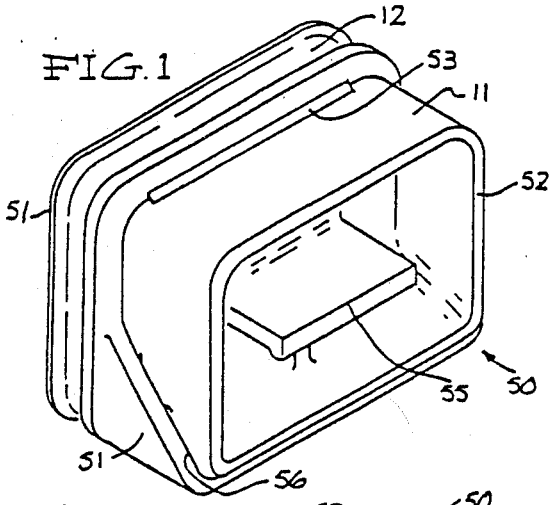
FIG. 1 is a perspective view of a first preferred form of a dispensing device in accordance with the present invention.
Figure 4:
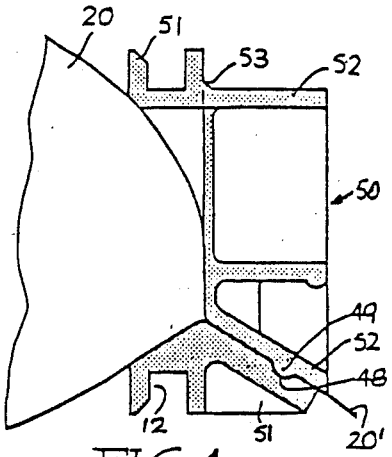
FIG. 4 is a view similar to FIG. 3, showing the clamping means in the aforesaid second position fixing the closed portion of the bag which extends through the dispensing opening.
Figure 2:
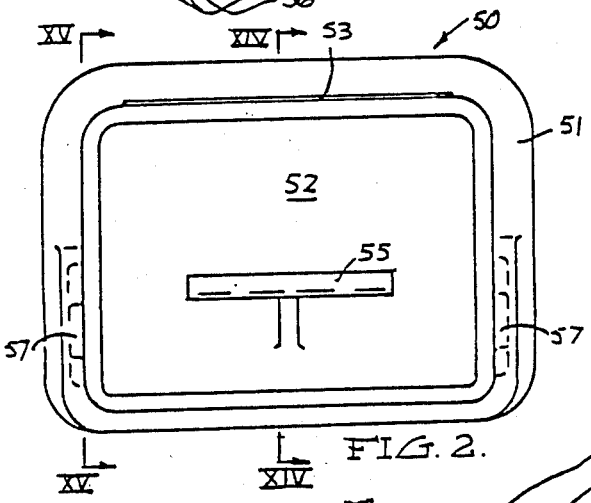
FIG. 2 is a front view of the device of FIG. 1.
Figure 3:
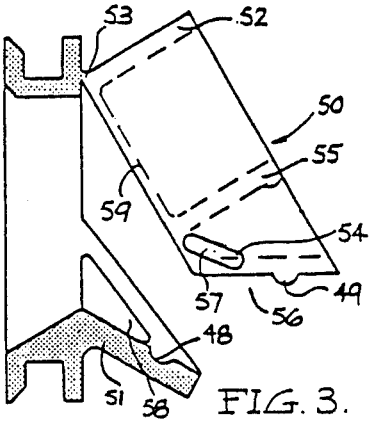
FIG. 3 is a longitudinal section through the device of FIG. 1 showing the clamping means in the aforementioned first position enabling a closed portion of a packaging bag (not shown) to pass freely through a dispensing opening.
Figure 5:
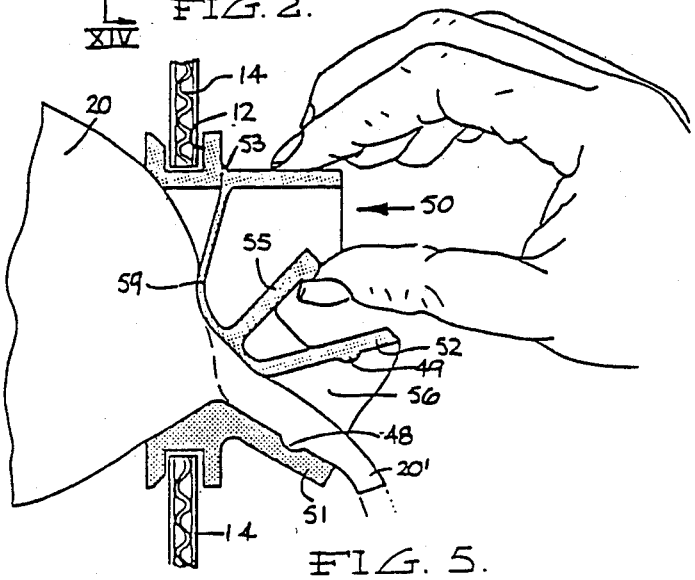
FIG. 5 is a view similar to FIGS. 3 and 4, showing the dispensing device upon use for dispensing.
Figure 6:
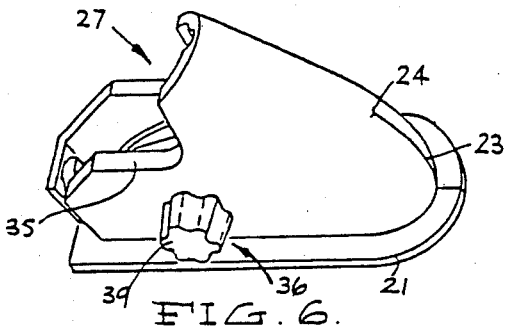
FIG. 6 is a perspective view of a second preferred embodiment.
Figure 7:
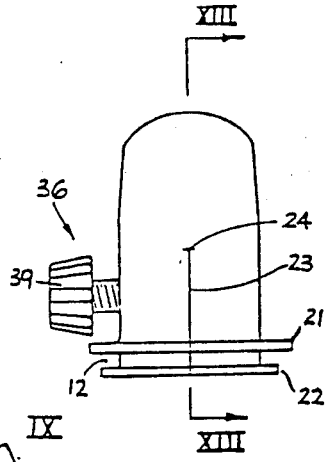
FIG. 7 is a side view of the device of FIG. 6.
Figure 8:
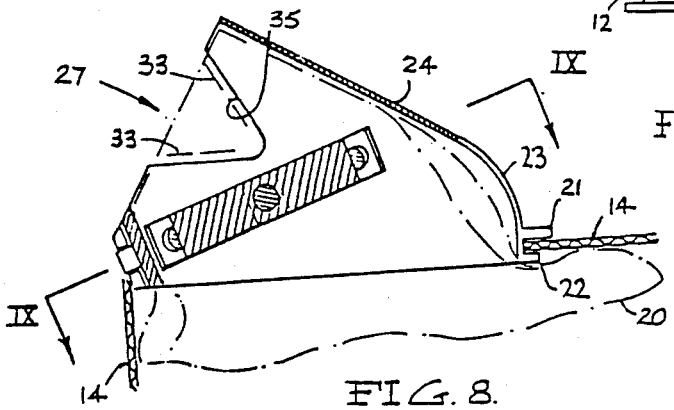
FIG. 8 is a section view along line XIII—XIII of Fig. 7.

A releasable detent device 54 is provided as part of the clamping mechanism to hold the parts 51 and 52 together in the closed position shown in FIG. 4. The detent device 54 comprises in this connection a pair of laterally protruding lugs 57 on the housing part 52, adapted to engage with corresponding recesses 58 on the housing part 51. In operation, i.e. after the bag 20 or the protruding bag portion 20' has been opened by the user, either by tearing or cutting a dispensing opening, liquid is dispensed by bending the wall 59 of the housing part 52. This takes place in the manner that a lever 55 protruding centrally on the wall 59 is gripped and pushed upward, as shown in Fig. 5. By this action a dispensing opening 56 is opened on the device 50 and makes it possible for liquid to flow out of the bag 20 as desired. The resilient or elastic development of the material of the dispensing device sees to the automatic closing of the part 51 against the part 52 as soon as the lever 55 is released.

FIGS. 6 to 10 show another illustrative embodiment of the dispensing device. The dispensing device has a pair of flanges 21, 22 arranged at the bottom which define between each other a groove 12 extending at least partially around the periphery of the device. It serves to receive the edge of an opening in a carton container 14 and thus hold the dispensing device in position of use. The body of the dispensing device is furthermore longitudinally slit along the line 23 which extends partially through the body so that housing parts on both sides of the line 23 can be swung away from and towards each other approximately about an axis 24 defined by the inner end of the line or slit 23. A clamping means such as an elastic detent hook 25 engages in a corresponding detent opening 26, whereby the body of the device is kept closed, as shown in the figure. Release of the detent connection 25, 26 makes it possible to open the body of the device, whereby a region of the closed bag of flexible material can be drawn into the device through its dispensing opening 27. A welded corner of the bag shown in FIG. 10 comprises, for this purpose, a pair of locating openings 28, 29 arranged on both sides of the corner and outwardly of the welding or wall-connection line 30 of the bag. The locating openings 28 and 29 are intended to be placed over corresponding locating spigots 31, 32 on the dispensing device, the purpose and operation of which will hereinafter be described. The corner of the bag between the locating openings 28, 29 further has opening indications 33, either tear lines or cutting marks, which are arranged on the closure flap 34 of the bag in the region of said corner provided with openings. Once the bag is correctly positioned by the locating openings 28, 29 and the dispensing device relative to each other, the closed or sealed corner region of the bag extends into the dispensing opening 27. In this position, the dispensing device is closed by engagement of the detent hook 25 into the corresponding opening 26. Thereupon, the opening indications 33 between wall parts 35 of the body of the device which surround the dispensing opening 27 are visible to the user and the user may, as desired, open the bag by tearing or cutting along the indications 33. The arrangement of the opening of the bag along the lower edge of the bag, together with the shape of the body of the device with its dispensing opening 27 directed downwardly, assures a downward flow of liquid from the bag when the dispensing device is operated by the user.

Figure 9:
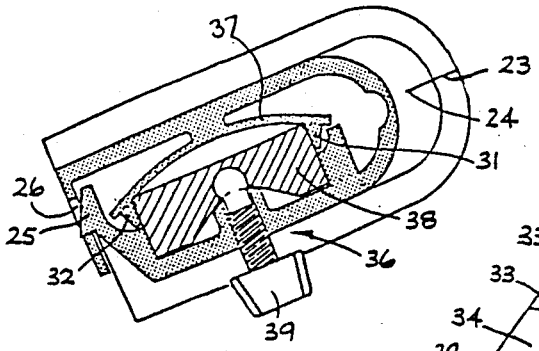
FIG. 9 is a section view along the line IX—IX of Fig. 8.
Figure 10:
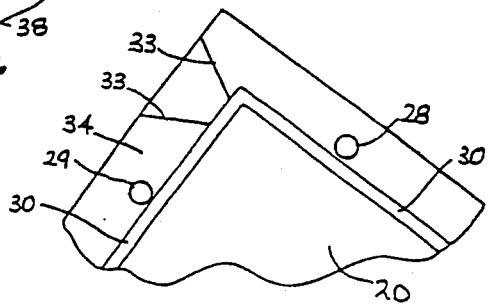
FIG. 10 is a corner portion of a bag for use with the device shown in FIGS. 6 to 9.

As is best shown in FIG. 9, this embodiment includes a novel dispensing-device actuating mechanism, shown generally by numeral 36. The dispensing mechanism 36 comprises a generally concave-shaped element 37 which supports the spigots 31, 32 for the locating of the openings in the corner region of the bag. Cooperating with this element 37 there is provided a piston 38 which is slideable axially within the body of the device. The movement of the piston 38 is controlled by an externally operatable screw drive 39. Rotation of the screw drive 39 will move the piston 38 either towards the concave element 37, tending then to flatten the latter, or away from said element, whereby the element 37 again assumes the concave shape shown in FIG. 9. With the bag 20 correctly located through the dispensing device with the actuating mechanism 36 as shown in FIG. 9, the bag will be opened and its content dispensed from the dispensing opening 27. Rotation of the screw drive 39 so as to move the piston 38 against the element 37 will stretch the bag material between the spigots 31, 32 and press the bag walls together in sealing fashion so that further discharge of the material contained in the bag is prevented.

Figure 15:
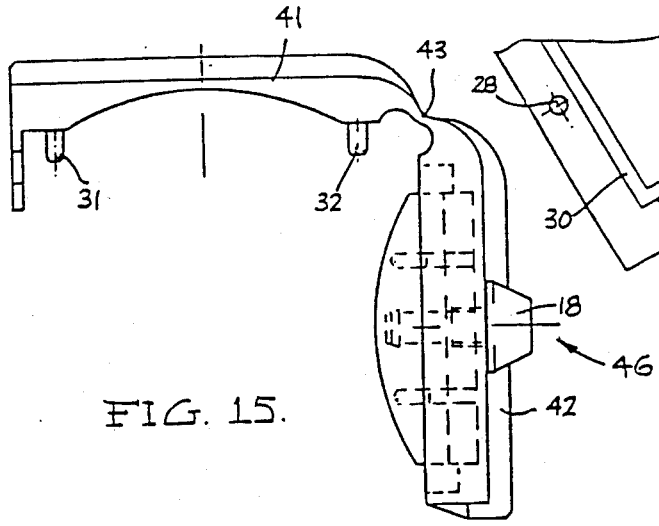
FIG. 15 is a front elevation of the device according to FIG. 11 in the aforesaid first position which enables a closed portion of a packaging bag to be introduced freely through the dispensing opening.
Figure 16:
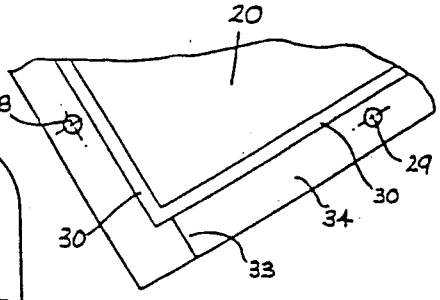
FIG. 16 shows a corner section of a bag for use with the embodiment of FIGS. 6 to 9 or 11 to 15.
Figure 13:
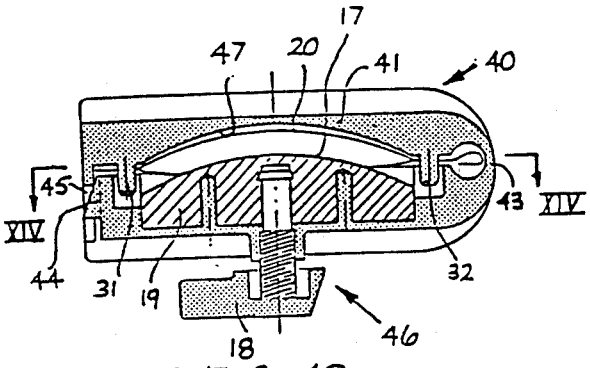
FIG. 13 is a section view along line XIII—XIII of Fig. 12.
Figure 12:
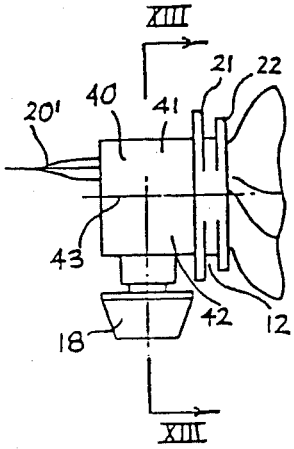
FIG. 12 is a side view of the device according to Fig. 11.
Figure 14:
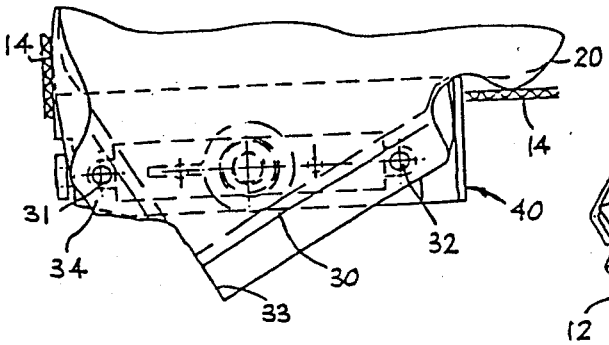
FIG. 14 is a section view along line XIV—XIV of Fig. 13.
Figure 11:
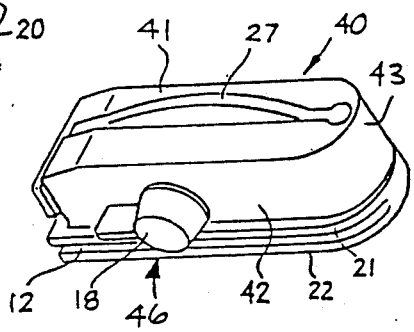
FIG. 11 is a perspective view of a third preferred embodiment of the present invention.

FIGS. 11 to 16 show a third preferred embodiment of a dispensing device according to the present invention. This embodiment is an alternative construction to that shown in FIGS. 6 to 9. The dispensing device 40 is essentially constructed integrally with two parts 41 and 42 which are connected at a hinge region of slight thickness 43 so that the two parts can be swung towards and away from each other. As shown in FIGS. 11 and 13, the two parts are closed by engaging an elastic hook 44 on one part into an opening 45 in the other part of the body of the dispensing device. In the open position of the device, as shown in FIG. 15, a closed or sealed corner region of a bag is introduced, the locating openings 28, 29 on the bag being placed over locating spigots 31, 32 on the device part 41. Upon closure of the two parts 41, 42 the corner region of the bag 20 lying between the openings 28, 29 is clamped fast between the two parts 41, 42 of the body 40 of the device. A still closed or sealed corner region 20' of the bag or its edge protrudes from the dispensing device and may be opened as desired by the user either by tearing or cutting the indications 33 provided on one of the lower corners 34 of the bag, namely the corner region of the bag which is clamped fast. This arrangement assists in the downward flow after the bag has been opened.

In this embodiment, a dispensing-device actuating mechanism 46 is provided, comprising an inwardly curved concave surface 47 in the part 41 as well as a piston 19 and an externally actuatable screw drive 18 on the part 42. The piston 19 has a convex piston surface 17 facing towards the concave surface 47 and is moved towards and away from the surface 47 guided on the guide bolts 16. Its movement is controlled by the screw drive 18. In the open position of piston 19 with respect to the surface 47 shown in FIG. 13, the material of the bag 20 between the locating bolts 31, 32 is relatively loose, which makes it possible for liquid to discharge through the dispensing opening 27 formed between the convex piston surface 17 and the concave facing surface 47 on the part 41. By actuation of the drive 18, the piston 19 is driven against the part 41, as a result of which the material of the bag is stretched between the bolts 31 and 32. In this way the walls of the bag are also pressed against each other, as a result of which the corner of the bag is again sealed there.

FIGS. 17 to 20 will now be described. The embodiment of the dispensing device 80 shown here is again formed essentially of two parts 81 and 82. They are connected in the manner described hereinafter. The first part 81 has a substantially cubic shape, as seen in the front elevation of FIG. 17, and comprises a peripheral groove 12, similar to the previously described embodiments, in order to fix the part 81 in an opening in a wall 14 in a "bag-in-box" outer container. The second part 82 comprises a pair of laterally extending spigots 83 which fit into pivot holes 84 of the part 81, as a result of which a hinge connection is formed between these two parts. Preferably a slight obstruction in movement, either by friction or by interference fit, is provided between the two parts 81 and 82 so that any relative movement of these parts is possible only by intentional movement by a person who wants to operate the device also in this manner.

Figure 18A:
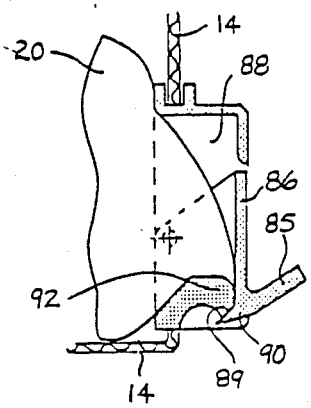
FIGS. 18A and 18B are section views along line XVIII—XVIII of FIG. 17 in the closed and open positions of the device.
Figure 18B:
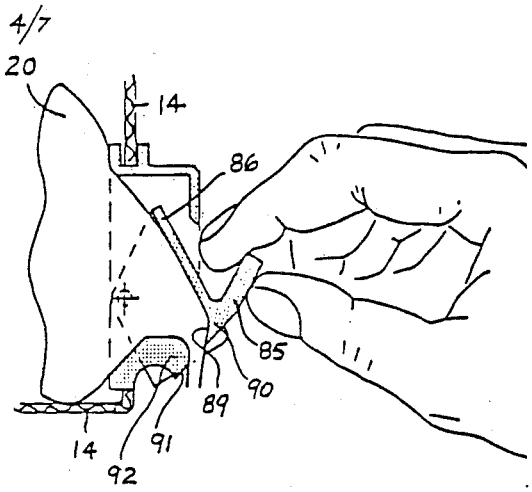
Figure 17:
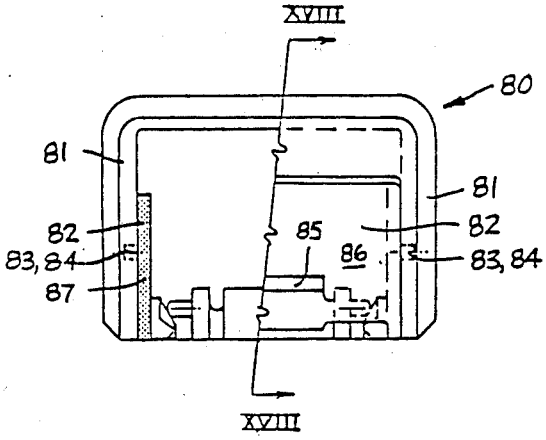
FIG. 17 is a front elevation view, partially in section, of another preferred embodiment of the dispensing device of the invention.
Figure 20:
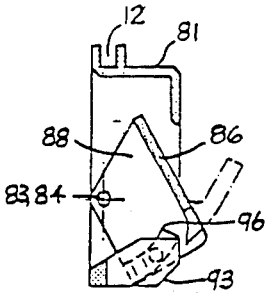
FIG. 20 is a section view along the line XX—XX of Fig. 19B.

The second movable part 82 comprises an operating handle 85 integral with a front wall 86 and side walls 87 and 88 on which the pivot spigots 83 and 84 are formed. As is best shown in FIGS. 18A and 18B, the second device part 82 comprises a clamping surface 89 on a lip 90 which cooperates with an opposing surface 91 on a lip 92 of the stationary first part 81. In the closed position shown in FIG. 18A, the two surfaces 89 and 91 lie against each other, they being substantially tangential to a circular arc with its center at the pivot axis defined by the spigots 83. In this manner, no internal forces which could tend to move the part 82 into open position from the closed position are present and thus the dispensing device remains closed until it is manually opened.

Figure 19A:
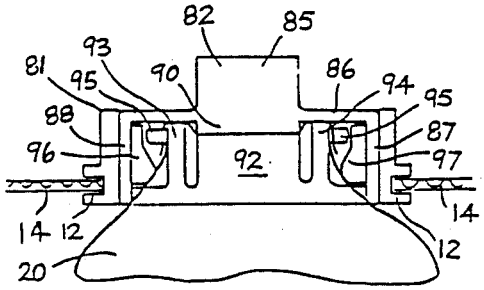
FIGS. 19A and 19B are schematic views similar to Figs. 18A and 18B but with the section lines displaced 90°.
Figure 19B:
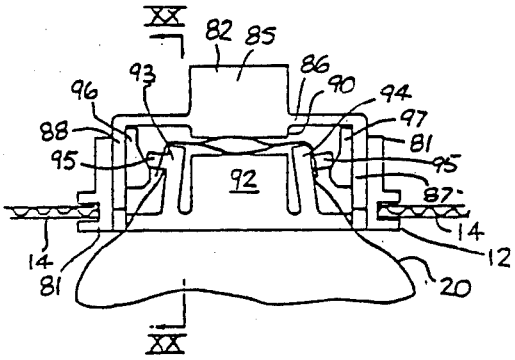
Figure 21A:
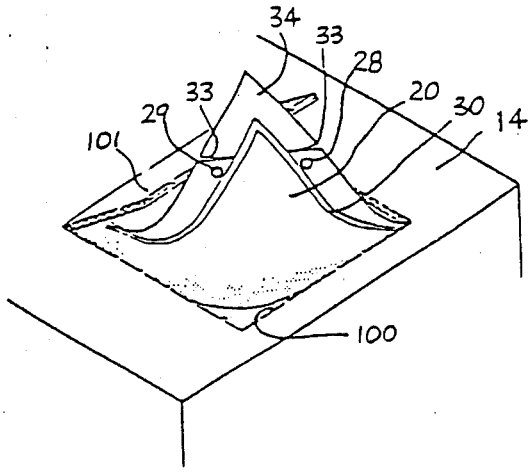
FIGS. 21A to 21D are a series of perspective views showing the steps for the application of a dispensing device, particularly the one illustrated in FIGS. 17 to 20, in a "bag-in-box" packaging system.
Figure 21B:
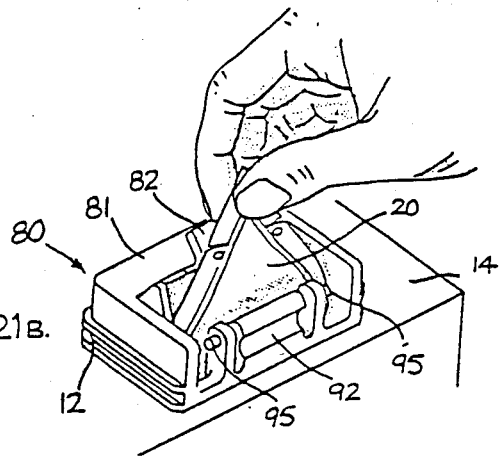

The stationary first part 81 of the dispensing device comprises a pair of laterally spaced projecting tabs 93 and 94 each carrying outwardly directed aligned projections or locating pins 95. They serve to receive over them locating openings 28, 29 on the edge of the bag 20, as shown in Figs. 21A and 21B. The protruding tabs or walls 93, 94 are so developed that they can be flexed laterally, as shown in FIG. 19B. Moreover, the walls 93, 94 extend beyond the tongue region 92 of the stationary part 81 in order in this way to define a concave region in which the bag 20 is stretched in the closed position of the device, on the one hand by engagement of the lips 90, 92 on the bag 20 which, on the other hand, is fixed on the locating bolts 95.

The movable part 82 of the dispensing device comprises guide surfaces 96, 97 on side walls 87, 88 so that, by a swinging of the part 82 into open position in accordance with FIG. 19B, these guide surfaces 96, 97 come into contact with the locating pins 95, whereby the walls 93 and 94 are bent inwards. The bag portion 20 between the locating pins 95 is then loose and permits delivery of the material. Upon the closing of the dispensing device, the guide surfaces 96, 97 release the pins 95, and the walls 93, 94, due to their resiliency, flex back to the normal position shown in Fig. 19A. Here the bag is again stretched between the locating pins 95 and the lip region 90, 92, closed in sealing fashion there.

In FIGS. 21A to 21D there is shown a sequence of the steps for the installing of the dispensing device, especially constructed in accordance with the one preferred embodiment shown in FIGS. 17 to 20. Initially an opening 100 is formed in the outer package or carton 14 by lifting off a region 101, which opening, possibly with the region 101, is thereupon brought into engagement with the dispensing device 80.

Figure 21C:
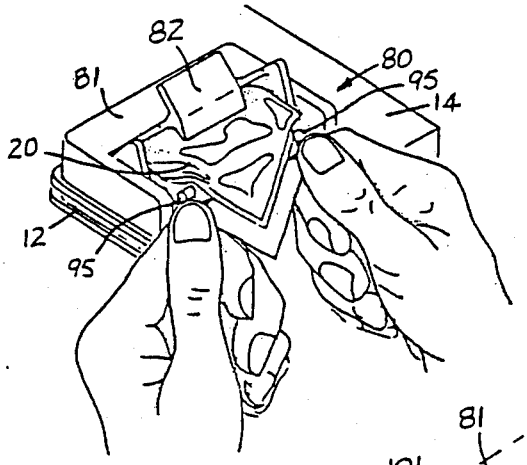
Figure 21D:
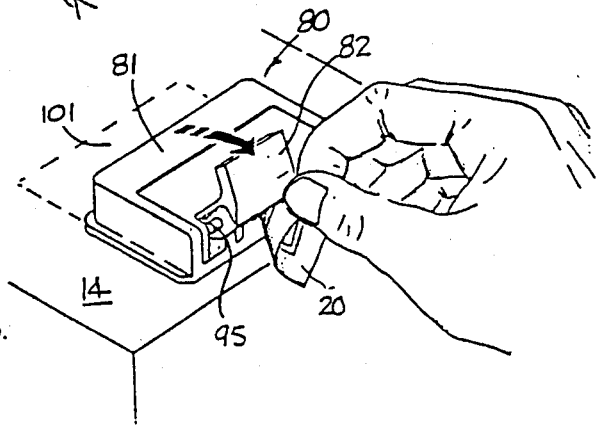

A corner region of the still sealed or closed and filled bag 20 extends outwardly through said opening so that the locating openings 28, 29 are exposed, as well as the opening indications 33 provided on the bag edge 34 which lies on the outside with reference to the weld seam. As shown in FIGS. 21B and 21C, a dispensing device 80 is placed in open position over the opening 100. The corner region of the bag 20 is pulled through the dispensing opening of the dispensing device and the locating openings 28, 29 are placed over the locating pins 95. Once this has been done, the part 82 is bent over in the direction indicated by the arrow in FIG. 21D into the closed position in which the region of the bag corner is firmly clamped between the two parts 81, 82. In this position the corner region of the bag can now be torn or cut off along the opening indications 33, whereupon bag and dispensing device can be operated in the usual way.

The effect with the dispensing device closed that the bag, once opened is stretched and is furthermore brought under sealing pressure, as shown in the embodiments in accordance with FIGS. 6 to 20, assures a very efficient sealing of the bag as desired, without interfering with the delivery of the material contained in the bag, preferably a liquid, upon the opening of the device.

Figure 24B:
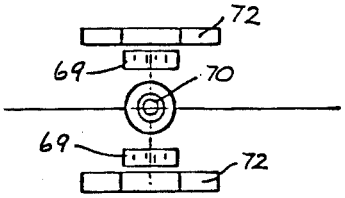
Figure 24C:
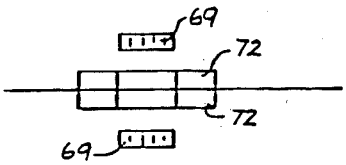

Reference will now be had to FIGS. 22 to 24 in which a filling process and a machine operating in accordance with the process respectively are shown for filled bags closed on all sides which are suitable, in particular, for the use of the dispensing devices described.

Figure 23A:
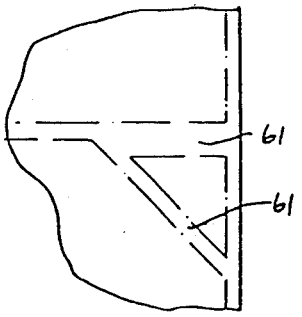
FIG. 23A shows a design modified with respect to the bag weld design shown in FIG. 23.

As shown in FIG. 22, on a filling machine for "bag-in-box" bags, preferably for use in connection with the dispensing devices previously described, there is provided a bag roll 60 having a continuous bag web of flexible material, on which weld seams 61, such as shown in FIGS. 23 and 23A respectively, have been previously prepared. The bag web is drawn from the roll 60 and lead via a guide roller 62 around an upper roll 63. Thereafter, the web is drawn downwardly over a table generally arranged at an angle of approximately 60° to the horizontal, along which various treatment steps are carried out. The reason for the inclined position of the table is so that when the bag is filled with a material, particularly a liquid material, all of the air will emerge from the bag since the filling opening, due to said inclination forms the apex, thus avoiding the presence of air bubbles in the packed liquid material. Moreover, the upper corner welds of the bags, as seen in FIG. 23 or 23A, are developed generally convex, considered in the direction of advance, with respect to the longitudinal direction of the web, and in particular their side regions are developed at an oblique angle with respect to said direction in order to minimize the possibility of air pockets in these corners.

At a first treatment station 64, the central region of the bag fed in each case is cut open along a line 65 as shown in FIG. 23 in order to provide a filling opening. If desired, a dispensing device can be attached in this stage of manufacture by arranging dispensing devices in a magazine beneath the table and in each case applying one of these dispensing devices to the lower edge of the bag at the treatment station 64. However, it is preferred to apply dispensing devices only later. From the station 64 the web passes, as seen in direction of travel, a sensor 66 for controlling the position and feed of the bag and then a pair of driver rollers 67, in order, finally, to reach a second station 68. A pair of suction heads 69 are provided here to spread the bag by suction along the line 65 as shown in FIGS. 24A and 22. If the bag material is constructed of more than one layer, it may be advisable, as a preliminary step, to weld or in general join the individual layers, after the formation of the opening, as at 65, to each wall in order to make certain that opening access is had into the actual interior of the bag which is to be filled. A conventional filling arrangement 70 is then moved down into the bag opening 65, suction openings 71 being possibly provided thereon in order to pull the edge of the opening now against the filling spout and in order also to assist in the withdrawal of air from the bag interior, as shown in FIG. 24B. After the end of the filling process, the filling arrangement 70, together with the suction heads 69, is withdrawn and a pair of sealing jaws 72 is placed in use in order to seal the opening 65.

While the bag is being filled at the treatment station 68 as has been described, it is supported at its base by guide roller elements 73. Thereupon, the individually filled bags 20, which are still attached at the station 68 to the web of bags to be filled, are separated from each other and transported further, being deposited in open outside cartons which have been erected, for instance, by a device such as described in co-pending Australian Application No. 88'817/82.

It is self-evident that the foregoing describes merely one preferred embodiment of the bag production, filling and closing. Since, however, the present invention proposes the provision of dispensing devices which do not themselves damage the bag material, other filling processes and corresponding machines may also be employed. Thus, for example, a tube of flexible bag material may be formed and filled with the desired liquid product, whereupon the tube is cross sealed through the liquid product, whereby the inclusion of air in the filling product is practically impossible. Such bags could then simply be separated along the cross sealing and be packed in suitable outside packings or cartons.

I claim:

1. A dispensing device for a bag-in-box container, comprising:

a housing;

first securing means for attaching said housing to said box;

second securing means separate from said first securing means for releasably holding at two spaced locations a portion of said bag to be opened, said second securing means being operable to secure said portion of said bag whether or not said first securing means has secured said housing to said box; and valve means attached to said housing, said valve means in cooperation with said second securing means being operable for selectively stretching said portion of said bag over a course between said spaced locations to close said bag, or reducing said course of said bag portion to open said bag portion;

said valve means comprising a resilient stretching member and an actuator means acting on said resilient stretching member to reduce or enlarge said course of said bag portion; and said second securing means comprising a holding means mounted on said resilient stretching member.

2. The device according to claim 1, wherein said housing comprises a pair of parts releasably fixed to one another.

3. The device according to claim 2, wherein said first and second parts of said housing are swingably coupled to each other.

4. The device according to claim 3, wherein said first and second parts are swingably coupled about an axis and wherein said valve means includes first and second mateable surfaces respectively on said first and second parts and tangential to said axis, said first and second surfaces arranged on said first and second parts so as to be spaced closely together to further aid in closure of said bag portion in a first position and spaced from each other in a second position when opening of said bag portion is desired.

5. The device according to claim 1, wherein said valve means comprises a piston means movable between first and second positions in which said bag portion is opened and closed, respectively.

6. The device according to claim 1, wherein said actuating means act on said resilient stretching member to reduce said course of said bag portion.

7. The device according to claim 1, wherein said actuator means acts on said resilient stretching member to enlarge said course of said bag portion.

8. A dispensing device for a bag-in-box container, comprising:

a housing;

first securing means for attaching said housing to said box;

second securing means separate from said first securing means for releasably holding at two spaced locations a portion of said bag to be opened, said second securing means being operable to secure said portion of said bag whether or not said first securing means has secured said housing to said box; and valve means attached to said housing, said valve means in cooperation with said second securing means being operable for selectively stretching said portion of said bag over a course between said spaced locations to close said bag, or reducing said course of said bag portion to open said bag portion;

said valve means comprising a resilient member and said second securing means comprises a pair of spaced pins, one of said pins being attached to said resilient member, said resilient member being configured such that said spaced pins are movable towards and apart from each other by yieldably deforming said resilient member.

9. The device according to claim 8, wherein said valve means further comprises an actuator for pressing said resilient member and deforming said resilient member in such a manner that said pair of pins moves further apart from each other; said actuator comprising a first lip portion and a second lip portion on said housing; said first and second lip portions being swingably coupled to each other so as to squeeze said portion of said bag between said lip portions when said pair of spaced pins are moved further apart from each other and to release said portion of said bag when said pair of spaced pins are moved towards each other.

10. The device according to claim 9, wherein said second lip portion is affixed to the housing.

* * * * *